United States Patent [19]

Burroughs et al.

[11] 4,279,663

[45] Jul. 21, 1981

[54] REACTOR SYSTEM AND PUMP APPARATUS THEREIN

[75] Inventors: Reginald L. Burroughs, Trenton; William J. Thompson, Lambertville; Derek Wooldridge, Princeton, all of N.J.

[73] Assignee: American Can Company, Greenwich, Conn.

[21] Appl. No.: 136,470

[22] Filed: Apr. 2, 1980

Related U.S. Application Data

[62] Division of Ser. No. 2,886, Jan. 12, 1979, abandoned.

[51] Int. Cl.[3] ..... C13K 1/02

[52] U.S. Cl. ..... 127/1; 127/28; 127/37; 222/383; 417/900; 422/110; 422/112

[58] Field of Search ..... 127/1, 37; 422/110, 422/112, 202; 222/160, 162, 383; 417/516, 900

[56] References Cited

U.S. PATENT DOCUMENTS 2,735,792 2/1956 Kroyer ..... 127/1

4,023,982 5/1977 Knauth ..... 127/1

*Primary Examiner*—Michael S. Marcus

*Attorney, Agent, or Firm*—Robert P. Auber

[57] ABSTRACT

A reactor system for continuously effecting the hydrolysis of cellulosic materials, as relatively concentrated aqueous mixtures, comprises a tubular reactor, a high solids pump, steam injecting means, a discharge valve controlled by pressure-responsive means, and means for collecting and recovering the reaction products from the hydrolyzate. The high-solids pump apparatus utilizes a valve having a flow distributing passageway of arcuate, uniform circular cross-section. The various portions of the apparatus are constructed with uniform internal dimensions and configurations, so as to avoid any constriction to flow of the material therethrough, thus minimizing the tendency for blockages to occur therewithin. The loading mechanisms are unloaded alternatingly by a reciprocating ram, so as to substantially continuously feed material through the associated valve.

3 Claims, 10 Drawing Figures

FIG. 3
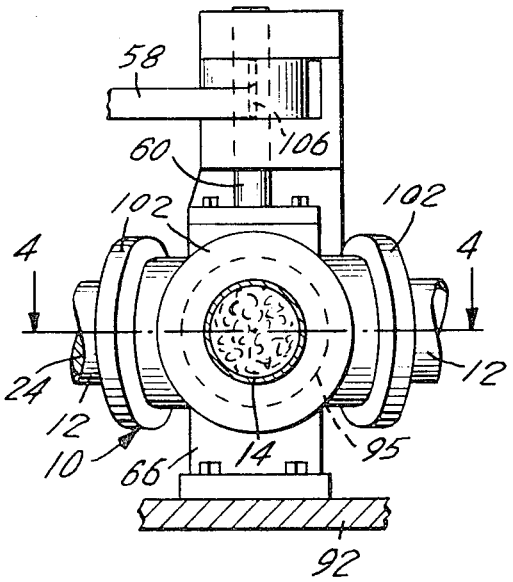
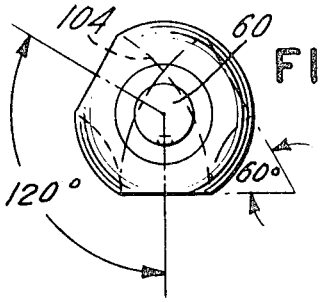
FIG. 6
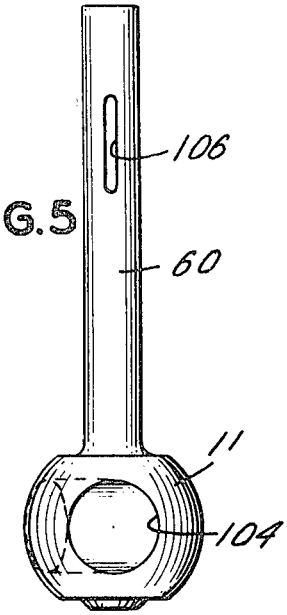
FIG. 5
FIG. 4
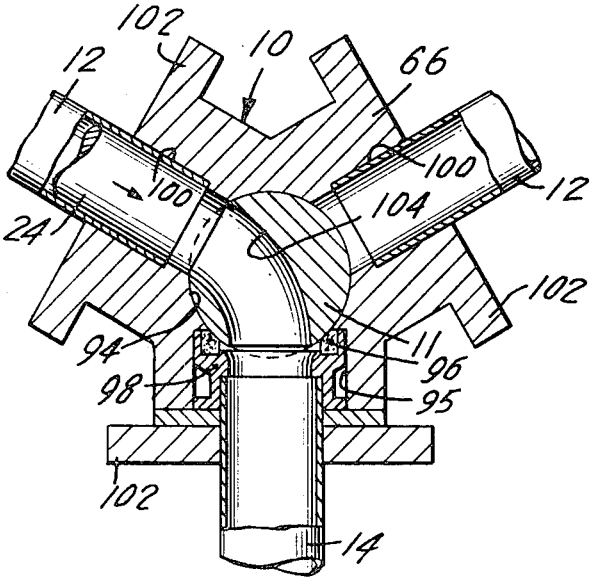
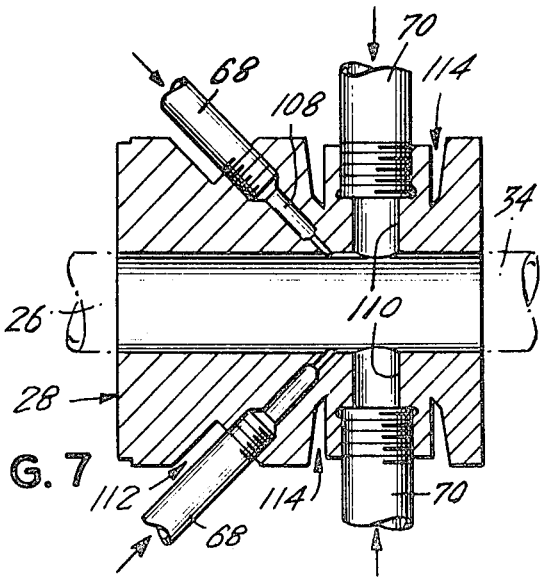
FIG. 7

REACTOR SYSTEM AND PUMP APPARATUS THEREIN

This is a division of application Ser. No. 2886, filed Jan. 12, 1979, now abandoned.

BACKGROUND OF THE INVENTION

Traditionally, used paper and agricultural by-products, such as sawdust, wood waste, corncobs, straw, sugar cane bagasse, rice hulls, and the like, have been regarded essentially as waste materials, and have been disposed of through incineration or by other, similarly unproductive means. It is well known that the cellulosic constituents of such materials can be hydrolyzed to produce more valuable products; however, such operations are in limited use, due largely to the relatively low return-on-investment which they are capable of generating. The capital expenditures required to design and construct the facilities necessary for carrying out such recovery operations tend to be very significant, thus demanding that relatively high conversion rates be attainable, in order to justify the expense involved. Moreover, the ready availability of the same or similar reaction products, from alternative sources and at relatively low cost, renders it that much more difficult to justify the adoption and use of any new scheme.

The presently known methods of hydrolyzing cellulosic materials are not, by-and-large, considered to be commercially feasable, for a number of reasons. In certain instances, the processes are not readily adapted to continuous operation; they typically require excessively long reaction times, and the reactions are normally carried out at low solids concentrations, all of which seriously limits productivity. Moreover, the known methods do not afford such control as would enable utilization to produce products of greatest value and salability.

A major impediment to the development of a commercially practical hydrolysis process resides in the reactor system employed. In a broad sense, the systems heretofore designed have not, so far as is known, permitted a sequence of operations to be carried out in such a manner as would permit the throughput rates and reaction control that are now deemed to be necessary to commercial feasibility. In a more specific sense, the focal point of the inadequacy of prior attempts to carry out hydrolysis, in the high solids concentrations required for adequate economics, lies in the inability to introduce efficiently the relatively dry mixtures which characterize a high solids cellulosic feed material. In other words, pumping apparatus presently available is not capable of reliably handling the feed materials which must be used to render a commercial method economically justifiable.

Accordingly, it is an object of the present invention to provide a novel reactor system for continuously effecting the hydrolysis of cellulosic materials as relatively concentrated aqueous mixtures.

It is also an object of the invention to provide such a system which is capable of handling mixtures of the foregoing type, which reduce the tendency for the mixtures to dewater, and thereby clog the system.

A more specific object of the invention is to provide high solids pump apparatus suitable for use in such a system, through which the high solids aqueous mixtures may move relatively freely, thereby minimizing dewatering and clogging, which apparatus is also capable of feeding the material at high rates and with good efficiency.

Even more specific objects are to provide a novel valve, so designed as to promote such operation of the pump apparatus, and a hopper arrangement which contributes significantly to the simplicity and efficiency of the system.

Yet another object of the invention is to provide such a system, apparatus and valve, which are of relatively uncomplicated construction, and of modest cost.

SUMMARY OF THE INVENTION

It has now been found that certain of the foregoing and related objects of the invention are readily attained in a reactor system comprising a tubular reactor, and high solids pump means. The reactor has an infeed end and a product discharge end, and a reaction zone therebetween. The high solids pump means is adapted to substantially continuously feed a relatively concentrated aqueous mixture of a cellulosic material into the reactor, and it is connected to the infeed end thereof. Means is provided for continuously injecting steam into the reactor at a location between the infeed end and the reaction zone thereof, and a valve is provided in the reactor, adjacent the discharge end thereof, which alternatingly closes and opens the reactor so as to prevent and permit discharge of the reaction mass therefrom. The system additionally includes control means for operating the valve in response to pressure within the reaction zone, thereby substantially continuously effecting the discharge of a portion of the reaction mass therefrom, and it includes means for collecting the hydrolyzate so discharged, and for recovering the reaction products contained therein.

In preferred embodiments of the system, the steam injecting means is also adapted for the continuous injecting of acid into the reactor at the same location. The system may additionally include cooling means for lowering the temperature of the hydrolyzate downstream of the valve provided therein, if so desired.

Other objects of the invention are attained in high solids pump apparatus comprising a valve which includes a housing having a chamber of circular cross-section therewithin, and three, equidistantly spaced coplanar ports extending radially from the chamber and providing communication therewith, two of the ports being inlet ports and the third being an outlet port. A ball is disposed within the chamber for rotation about an axis perpendicular to the plane of the ports of the housing, and it is dimensioned and configured for sealing engagement therewithin. An arcuate passageway of uniform circular cross-section extends through the ball, with the opposite ends of the centerline thereof displaced by 120°, so that the ball is pivotable about its axis between positions in which the passageway connects one or the other of the inlet ports with the outlet ports; means is provided for so pivoting the ball. The pump apparatus also includes a pair of loading mechanisms, one of which is operatively connected to each of the inlet ports of the valve housing. Each loading mechanism includes a loading barrel of uniform circular cross-section, which has an inside diameter substantially equal to that of the passageway through the ball of the valve, and is mounted on the housing in coaxial alignment with one of the inlet ports thereof. Each mechanism also includes a ram which is slideably received within the barrel thereof for reciprocal axial movement toward and away from the valve, and means for loading the barrel with the material which is to be pumped. The ram of the mechanism is disposed for movement from a first position with its inner end outwardly of the loading location of the associated barrel, to a second position closely adjacent the valve ball. Finally, means is provided for reciprocating the rams between such first and second positions thereof.

Usually, the chamber of the valve housing and the ball of the pump apparatus will be of generally spherical configuration. The passageway through the ball will preferably traverse an arc of about 60° therethrough, and an optimum ratio of the diameters of the ball and of the passageway cross-section would be about 2:1, and most desirably 1.9:1.0; in a specific case, the ball of the valve has a diameter of about three inches, taken through the plane of the ports. It is especially desirable that the edges of the ball defining the ends of the passageway therethrough be relatively sharp so as to facilitate movement of the ball through material present within the valve. In that instance, the valve is appropriately fabricated of hardened steel, and the valve additionally includes a sealing ring disposed within the housing thereof about the inner end of the outlet port. Such a sealing ring will be fabricated of a hard and durable material, and will be formed with relatively sharp edges to cooperate with the ball to shear material present within the valve, thereby further facilitating movement of the ball therethrough.

For most practical operation, the pump apparatus will additionally include drive means for pivoting the ball and for reciprocating the rams, and generally, control means will also be provided for the drive means, which control means is adapted to synchronize pivoting of the ball and reciprocation of the rams. More specifically, the synchronization is desirably such that, as the ram of one of the loading mechanisms moves to its second position, the ball pivots to connect the barrel of the "one" mechanism to the outlet port, through the passageway of the ball and through the "one" inlet port. The ram of the "one" mechanism retracts to the first position thereof, and the ram of the other mechanism moves from its first position to its second position. The ball pivots to connect the barrel of the "other" mechanism, through the "other" inlet port, to the outlet port during movement to the "other" ram to the second position thereof. In this manner, the ball cooperates with the rams to ensure that the loading barrels are at all times mechanically closed to any reaction zone to which the outlet port of the apparatus may be connected, thereby preventing blow-back of material, under pressure, through the loading means. Most desirably, the ball of the valve will not shift to register with one loading mechanism until the ram thereof has moved forwardly to relatively close proximity to the ball of the valve. The ram of the other mechanism will not begin to retract until the ball has shifted to register with the "one" loading mechanism.

Most desirably, each of the loading mechanisms will additionally include a swing hopper assembly. In those embodiments, the barrel of the loading mechanism will have an elongated section removed from one side thereof to provide a lateral, longitudinally extending apperture therein defined by upper and lower rectilinear edges. The hopper assembly will comprise an upper curved sealing plate, fixed adjacent one edge of the barrel, extending along the entire length of the upper edge of the apperture therein, and extending outwardly therefrom in the direction of the other side of the barrel. It will also include lower curved material support plate, fixed adjacent one edge of the barrel along the entire length of the lower edge of the aperture and extending outwardly therefrom in the direction opposite to that of the upper plate. The hopper of the assembly will be pivotably mounted to swing about a horizontal axis parallel to that of the barrel, and disposed thereabove. It will have a bottom opening defined by a first rectilinear edge, disposed on the upper plate, and by a second rectilinear edge, with the edges of the hopper being substantially equal in length to the apperture of the barrel. The second rectilinear edge of the hopper will terminate in a barrel element, which corresponds in dimensions and configuration to the removed barrel section, and which is adapted to close the barrel when emplaced within the aperture thereof. The barrel element of the hopper is disposed upon the lower plate, in alignment with the aperture, and the upper and lower plates thereof are of arcuate configuration, and disposed concentrically about the horizontal axis of the hopper. As a result, with the hopper in a first position in which the barrel element is spaced from the barrel, material in the hopper will be supported upon the lower support plate; from that disposition, the material may be charged and compressed into the barrel by pivoting the hopper to a second position, with the barrel element emplaced within the aperture of the barrel. The first edge of the hopper, and the barrel element at the second rectilinear edge thereof, scrape the upper surfaces of the upper and lower plates, respectively, during movement from the first to the second positions thereof; the upper plate closes the bottom opening of the hopper in its second position.

Again, for most practical operation, the means for pivoting the ball and the means for reciprocating the rams will include drive means, and the pump apparatus will additionally include drive means for pivoting the hoppers, as well as control means for all of the drive means provided. In that instance, the control means and drive means will be adapted to synchronize pivoting of the ball, reciprocation of the rams and pivoting of the hoppers. The synchronization will be such as to alternately load and discharge material into and from the barrels, and to position the ball to alternatively receive materials from each of the barrels, thereby substantially continuously delivering a supply of material to the outlet port of the valve.

BRIEF DESCRIPTION OF THE DRAWINGS

FIG. 3 is an elevational view of the ball valve employed in the pump apparatus of FIG. 2, taken along line 3—3 thereof and drawn to a further enlarged scale;

FIG. 4 is a horizontal sectional view of the valve of FIG. 3, taken along line 4—4 thereof and drawn to a yet further enlarged scale;

FIG. 5 is an elevational view of the ball used in the valve of FIGS. 3 and 4, drawn to the scale of FIG. 4;

FIG. 6 is a plan view of the ball of FIG. 5, showing, in phantom line, an alternative position thereof;

FIG. 7 is a horizontal sectional view of the injection block used in the system, drawn to an enlarged scale;

DETAILED DESCRIPTION OF THE ILLUSTRATED EMBODIMENTS

Figure 1:
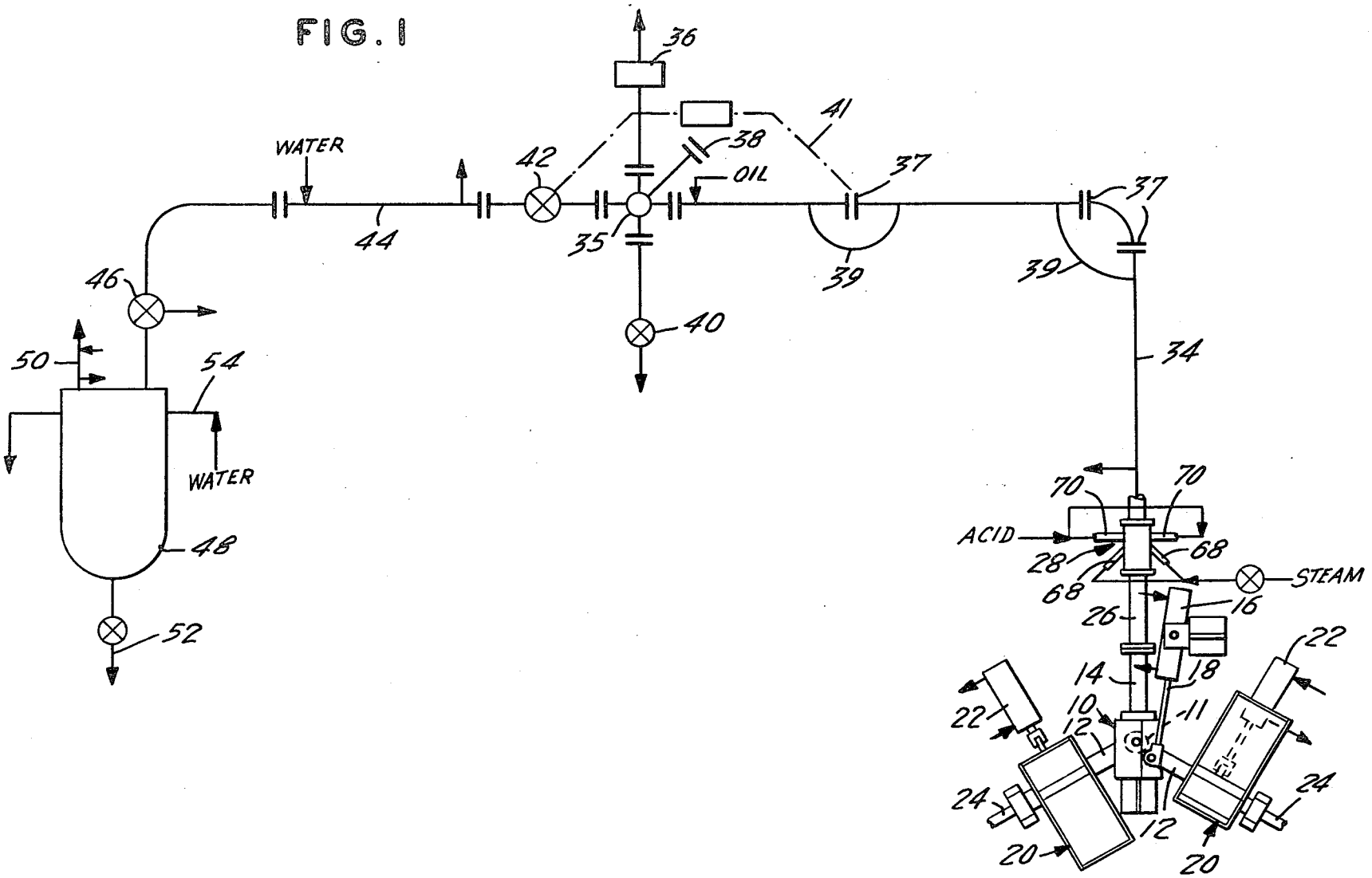
FIG. 1 is a schematic view of a cellulose hydrolysis reactor system embodying the present invention.

Turning now in detail to FIG. 1 of the drawings, therein illustrated schematically is a reactor system embodying the present invention, and comprised of a high solids pump apparatus, connected to a jacketed pipe reactor through a buffer zone and a steam and acid injection block, all to be described in greater detail; the reactor is relieved into a product collection tank, which also will be more fully described.

The pump section consists of a ball valve, generally designated by the numeral 10, the ball 11 of which has formed therethrough a single, accurately-machined, uniform-diameter curved channel, not seen in this Figure, so located as to provide communication alternatively between one of the feed barrels 12 and the outlet pipe 14, extending therefrom. The ball 11 of the valve 10 is mounted for rotation to alternatingly register its channel with one of the barrels 12, and it is so driven by the hydraulic cylinder 16, through the piston rod 18 thereof.

The pump 10 employs a pair of hoppers, generally designated by the numeral 20, each of which is pivotably mounted over one of the charging barrels 12, and are shifted hydraulically (by associated cylinders 22) between filling and charging positions. Briefly, each of the hoppers 20 opens and closes to deposit its charge into the associated barrel 12, with its associated ram 24 in its fully withdrawn position. The barrels 12 are alternately unloaded by the action of reciprocating feed rams 24, which are slideably mounted therein, with the movement of the hoppers 20 and ball 11 of the valve 10 occurring in timed sequence, in response to movement of the rams 24.

The outlet pipe 14 is connected to a buffer zone pipe section 26 which, in turn, is connected to an injection block, generally designated by the numeral 28. The block 28 is fitted with conduits 68, through which steam is injected, and with conduits 70 for acid injection. From the injection block 28, the mixture of feedstock, acid and steam is forced into the jacketed reaction zone 34, which is provided with means for hot oil circulation, to minimize heat losses and to ensure that the desired temperatures are maintained therein; the reactor also has instrumentation flanges 37 and oil jumpovers 39 provided at appropriate locations along its length. Adjacent the discharge end of the reaction zone 34 is a five-way cross 35, which is included to permit the incorporation of a rupture disk 36, an air leg 38, and a manual dump and clean-out valve 40. The main process valve 42 is located downstream of the five-way cross 35, and is automatically operated through an appropriate loop circuit 41, to maintain the desired pressure in the reaction zone, by periodically opening to discharge material, and thereby relieve the internal pressure; the design of the loop circuit 41 is conventional, and the numerous alternative forms thereof will be evident to those skilled in the pertinent art.

The discharged material procedes through a cooling section 44, which is provided to ensure that the temperature of the reaction mass is rapidly reduced, to thereby quickly terminate the reaction. Then the material passes through a valve 46, providing an alternate product discharge conduit, and ultimately into a product collection tank 48. The collection tank 48 is fitted with a condenser 50, by which vaporous products may be condensed and recovered; it also has a valved bottom discharge conduit 52, and cooling jacket 54, should it be necessary or desirable to lower the temperature of the product within the tank 48.

Figure 2:
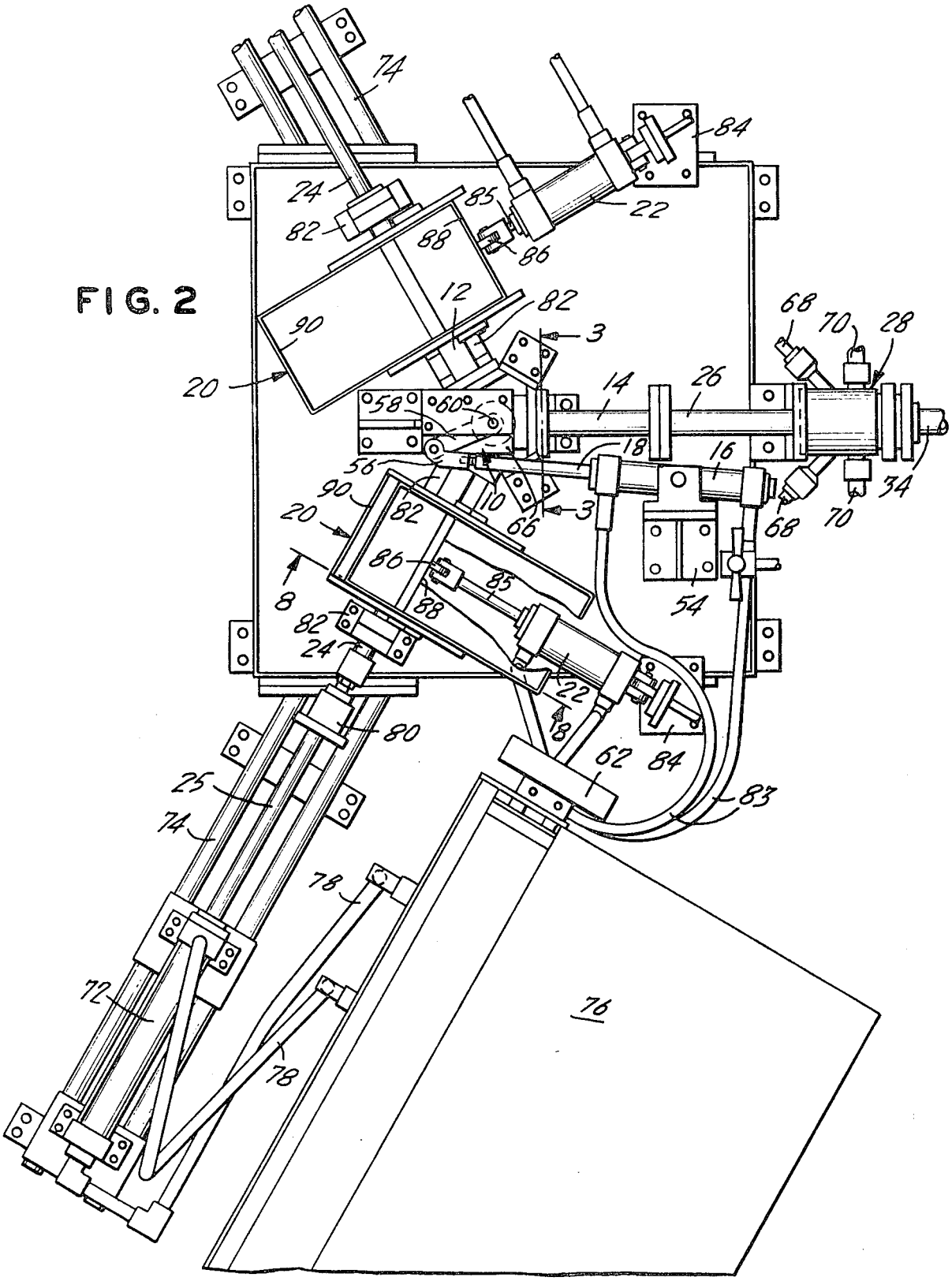
FIG. 2 is a fragmentary plan view of the high solids pump apparatus and the steam/acid injection block employed in the system, drawn to a greatly enlarged scale.

Turning now to FIG. 2 of the drawings, the high solids pump apparatus described above is there depicted in greater detail. The hydraulic cylinder 6 is pivotaly supported upon a mounting bracket 54, and its piston rod 18 is connected through a clevis 56 to the arm 58, which in turn is keyed to the stem 60 of the valve ball 11. Oil under pressure is delivered from a source 76 through hoses 64 to the cylinder 16 to pivot the ball 11 within its housing 66.

The apparatus includes two loading mechanisms which are virtually identical; therefore, only one need be described specifically, it being appreciated that both are encompassed by the description. The loading mechanisms are on axes which are equidistantly spaced from that of the outlet pipe sections 14, 26, and from one another (i.e., the axes are displaced by 120°). Each loading mechanism includes an hydraulic cylinder 72, which is mounted on an appropriate frame 74 and is connected to the hydraulic pump system 76 by hoses 78. The cylinder rod 25 carries the feed ram 24 on its forward end, and also mounts a switch activating collar 80 which, depending upon its position (and hence that of the ram 24), actuates the several switches (not shown) to thereby control operation of the valve cylinder 16 and the hopper cylinders 22. The ram 24 is slidably supported by appropriate bearing blocks 82.

The hopper-operating cylinders 22 are pivotably supported upon brackets 84, and are connected by air hoses 83 to the air source 62. The piston rods 85 thereof are pivotably attached to flanges 86 which project from the rear wall 88 of the pivotably mounted hopper bins 90. In the relationship shown in FIG. 2, the hopper 20 which is lowermost on the sheet is disposed with the associated feed barrel closed (by means to be described hereinafter), and with the associated ram 24 received therein in its forward position in proximity to the valve 10, the ball 11 of which is positioned to interconnect that barrel and the pipe section 14. The barrel of the upper loading mechanism is open, and the ram 24 thereof is in its fully retracted position. It will be appreciated that, in operaton, the upper hopper 20 will close to compress material into the feed barrel, the lower ram 24 will retract and the upper will move forward, and the lower hopper 20 will open to permit material to enter its associated barrel in preparation for the next phase of the feeding cycle; appropriate indexing of the ball will, of course, also occur, as will be described presently.

As best seen in FIGS. 3 and 4, the housing 66 of the valve 10 is mounted on an appropriate support member 92. The internal chamber 94 thereof is generally spherical, and is dimensioned and configured to receive the ball 11, and to rotatably and sealingly engage the ball therein. The outlet port 95 of the housing 66 is recessed to receive a sealing ring 96 and the insert 98, by which the ring 96 is mounted therein. The sealing ring 96 is so disposed as to engage the surface of the ball 11, thereby sealing the outlet side of the system against back pressure generated in the reaction zone. The inlet ports 100 of the housing 66 receive the ends of the charging barrels 12, and appropriate coupling flanges 102 are provided about each of the ports 95, 100, to permit assembly with adjacent sections of the system. Normally, the inlet port 100 would also have sealing rings (such as 96) appropriately mounted therein which cooperate with the ring 96 of port 95 to appropriately seat and seal the ball 11.

As pointed out earlier, the ball 11 of the valve 10 has formed through it an arcuate passageway 104, which is of uniform circular cross-section; it is important to note that the inside diameter of the charging barrels 12 is virtually the same as (but, in any event, not substantially larger than) the diameter of the channel 104. If this were not so, the material being fed would encounter an obstruction upon entering the ball 11, thereby impeding its passage therethrough and frustrating primary objects of the invention. It goes without saying that the inside diameter of the outlet pipe 14 may be greater than that of the channel 104 but, of course, it must not be substantially smaller, since intolerable constriction would again result.

With specific reference to FIGS. 5 and 6, the specific configuration of the ball 11, and of the channel 104 therethrough, can best be seen. Thus, it is evident seen that the opposite ends of the central line of the channel 104 are displaced by 120°, and that the passageway 104 traverses an arc of about 60° through the ball 11. Furthermore, it can be appreciated from those Figures that the ratio of the diameters of the ball 11 and of the passageway 104 cross-section is about 2:1. In FIG. 5, the keyway 106 by which a key (not shown) locks the arm 58 to the stem 60 is seen.

The injection block 28 is shown in detail in FIG. 7. It is machined to receive the conduits 68 and 70, with the bores 108, which threadably engage them, being formed at an angle and with a generally tapering cross-section, so as to afford a nozzle-like function. The conduits 68 carry the steam into the reaction mass, and their angular downstream attitude, as well as their taper, maximize the effectiveness of the steam in penetrating the reaction mass. The channels 110, through which the acid flows from the pipes 70, are directed in such a manner as to also ensure the thorough distribution of acid through the feed material. As will be noted, the block is appropriately relieved, as at 112 and 114; the structure at 112 is primarily for the purpose of providing flat surfaces for drilling and tapping the bores 108; those at 114 are primarily to provide gaps for maximum dissipation of the heat generated thereat.

Figure 9:
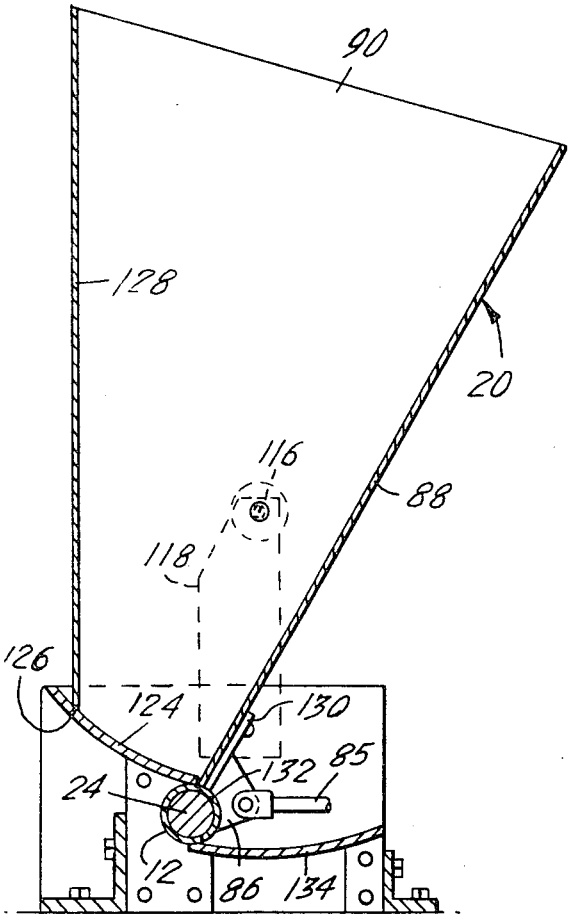
FIGS. 8 and 9 are vertical sectional views along line 8—8 of FIG. 2, showing the two alternate positions of one of the material feed hoppers used in the system, and drawn to a greatly enlarged scale.
Figure 8:
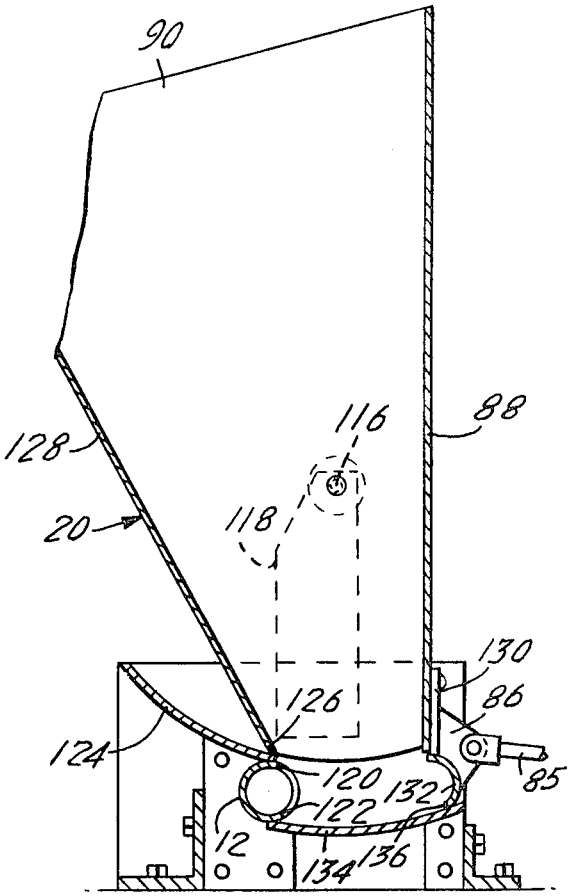
Figure 10:
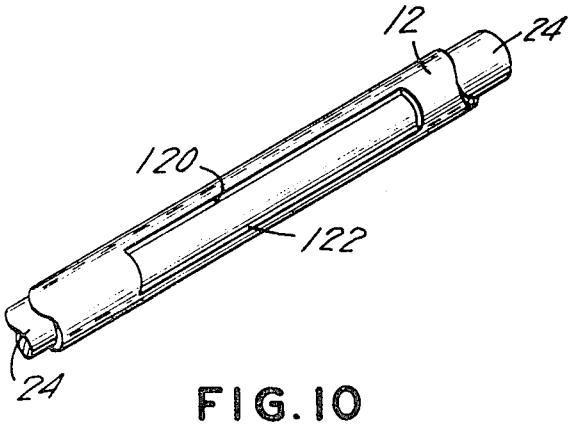
FIG. 10 is a fragmentary perspective view of the barrel section associated with the hopper of FIGS. 8 and 9, and of the ram received therewithin.

The hoppers 20 are illustrated in detail in FIGS. 8 and 9; as can be seen therein, the bin 90 thereof is pivotally mounted on an axle 116, which, in turn is horizontally mounted by an appropriate supporting structure 118. Also, mounted thereon is the associated charging barrel 12, which (as can most clearly be seen in FIG. 10) has a rectangular section removed therefrom so as to provide a window, defined by upper and lower margins 120, 122, respectively. Extending forwardly from adjacent the upper margin 120 of the barrel 12 is an upper upwardly curved plate 124, which is so disposed as to be wiped or scraped by the lower edge 126 of the front wall 128 of the bin 90, when the hopper 20 is swung between the positions thereof; the curvature of the plate 124 corresponds to an arc having, as its center, the axle 116.

Mounted on the same bracket 130 from which the flange 86 projects is an elongated curved element 132, which corresponds closely in dimensions in configuration to the section of the charging barrel 12 which was removed to define the window therein. Consequently, the element 132 is capable of closing that window when it is emplaced therewithin against the barrel 12. The lower edge of the element 132 is so disposed as to scrape the upper surface of the upwardly curved lower plate 134, which extends rearwardly from the lower marginal edge 122 of the barrel 12, adjacent to which the plate 134 is affixed. As is evident the bin 90 tapers downwardly and terminates in a bottom opening defined on two sides by the lower edges 126, 136 of the front wall 128 of the bin 90, and of the element 132, respectively.

Accordingly, with the hopper 20 in the position depicted in FIG. 8, material in the bin 90 will be supported upon the lower support plate 134. Shifting the hopper to the position of FIG. 9 will force the lowermost portion of the hopper contents through the window of the barrel 12, and compress that portion thereinto, with the element 132 wiping the support plate 134 and ultimately being seated within the opening of the barrel 12, to close the same; the remaining portion of the contents of the bin 90 are, in the position of FIG. 9, supported by the upper plate 124. Upon completion of that operation, the ram 24 will move through the barrel 12 to force the slug of feedstock contained therein further into the system; in FIG. 10, the ram 24 has done so (the element 132 has been eliminated, for clarity of illustration).

In an automated system, the pump apparatus so described would appropriately function in accordance with the following sequence. Arbitrarily designating the loading systems and their associated rams "A" and "B", at the commencement of the cycle, ram B may be regarded to be in its fully forward, extended, position (with its leading end adjacent the valve), and ram A may be regarded to be in its fully rearward, or retracted, position (with its forward end disposed outwardly of the location at which material is charged into its associated charging barrel). From those positions, ram A proceeds forward at low pressure to a point approximately half way through its full stroke, whereupon the ball of the valve indexes to connect barrel A with the outlet side of the valve; ram B remains in its fully extended position. While ram A continues to move forward (under high pressure), and after the shifting of the ball is completed, ram B begins its return stroke. Thereafter, pivoting of the ball to its position of full registration with ram A is completed, while the ram continues to full extension. In the meantime, the hopper of loading mechanism B operates to charge material into the charging barrel of that mechanism, and the ram thereof achieves its fully retracted position. Thereafter, the second half of the cycle commences, with ram B starting its forward stroke, while ram A remains at rest, fully extended.

In one specific embodiment, the ball of the valve was made of hardened steel, and was essentially spherical, with a diameter of 2.95 inches. The passageway therethrough had a diameter of 1.55 inches, and it circumscribed a 60° arc with a radius of 2.174 inches, taken from a center point displaced radially from the axis of the ball by a distance of 2.10 inches. Thus, the ratio of the diameter of the ball to that of the passageway cross-section was 1.9:1.0. Such a valve was utilized in a reactor system having a nominal inside diameter of 1.5 inches, and an overall length of 34 feet, the internal volume of which was about 0.48 cubic foot.

Thus, the pump of the preferred embodiments is hydraulically driven, and of the positive displacement piston type, thereby affording a high level of efficiency, and avoiding the need for finely dividing or grinding of the material to be fed into the system. The ball and the inlet ports provide flow passages of accurate and uniform cross-section, which greatly facilitate movement of the material therethrough, and without which blockages would occur. More particularly, any impediment to movement would tend to cause material to accumulate, thus resulting in a loss of water, with increasing difficulty of passage; once that begins to occur, the total cessation of the feedstock movement through the system quickly results. It is important to note that, whereas ball valves are widely used, as far as is known, no such valve is available which is provided with a passageway of the sort which is described herein. Typically, such a valve is formed with a spherical internal cavity within the ball; such a construction is found to be totally inoperative in a system of the sort herein described, which is intended for the processing of feedstock materials containing high percentages (i.e., 20 to 45) of solids. Uniformity of dimensions are of critical importance, not only with respect to the circular cross-section of the passageway, and to its arcuate configuration, but also with respect to the relationship between the passageway and the conduits connected thereto. It is believed that the material passes through the valve in the form of defineable disks, or "poker chips", which result from the alternate charging of the valve from the two feed sources, the disks being disposed perpendicularly to the center line of the passageway; this is believed to be a unique flow mode.

The hoppers described provide a positive and uniform means of feeding the raw material into the system, which precompresses the material to achieve maximum loading (i.e., density) of the system; the precompression afforded by the hoppers is at a ratio of approximately 2:1, compared to a conventional hopper. In so doing, the hoppers simplify the pump apparatus and valving necessary within the reaction system. Because of their oscillation, the hoppers prevent bridging of high solids material charged thereinto, thus further improving the operation of the overall system. By adding an adjustable baffle to the hopper, it is possible to provide a variable throat opening, so as to control the amount of material being fed into the chamber of the feed barrel. This would add flexibility of feed control, and would enable the system to accommodate the widest range of materials for processing. While the ports of the valve are desirably equidistantly spaced, with the end of the centerline of the arcuate passageway through the ball being displaced by 120°, that is not necessarily the case; for example, the displacement may be 135°, with the valve ports appropriately disposed.

Although not illustrated, it may be desirable to bevel the front end of the ram, since doing so will promote a shearing action, and thereby facilitate its movement through the dense feedstock delivered into the charging barrel. In addition, or alternatively, the feed ram, which is desirably constructed of a stainless steel rod, may be provided with lead end elements which are particularly adapted for operation in the present apparatus. Specifically, the lead end assembly may be composed of a bronze end cap, backed by two DELRIN (acetal resin) plastic rings, with a polyurethane ring therebetween. In such an assembly, the bronze end cap serves to isolate the ram thrust forces from the plastic rings, and to transmit the compressive load directly to the ram. The DELRIN rings serve as the ram end bearings within the barrel chamber, and the urethane ring provides a watertight seal therewithin. This is achieved by virtue of the slight amount of axial compression which may be imparted to the urethane ring, the level thereof being variable, and being subject to precise adjustment through the use of shims under the bronze end cap.

In regard to the injection block, in which both steam and also acid are desirably introduced into the reactor, this member would normally be constructed of a material which is highly resistant to corrosion. The nozzle-like bores through which the steam and acid are injected are desirably precisely positioned so that the four streams intersect, since this will produce most efficient reaction conditions. The acid nozzles may most desirably be fabricated of ceramic material in the area exposed to heat, and the bores may be so disposed as to effect a swirl of the reaction mass, such as by locating them off-center (i.e., tangentially) of the reacting material.

The system and pump apparatus hereinabove described are especially well suited for processing paper and agricultural by-products, of the sort hereinabove described, to effect the saccharification of the cellulosic constituents thereof. The process may be carried out in the system utilizing relatively short reaction times of about 1 to 10 minutes, with reaction masses containing high concentrations of solids (i.e., from about 20 to 45, and preferably 30 to 40 percent), and with such control as will promote the production of end products which are of relatively high value. In particular, the system would typically be operated at temperatures of about 190° to 225°, and preferably at about 200° to 210° Centigrade, with attendant pressures of about 200 to 400, and preferably 250 to 300, pounds per square inch, gauge. The normal and most valuable products which can be obtained through such processing of the cellulosic materials described are glucose and furfural, the latter being readily recoverable through the vaporization which takes place with the relief of pressure which attends the discharge of the hydrolyzate from the system. The details of the saccharification process for which the system and apparatus of the present invention are especially well suited, are set forth in a commonly assigned application for U.S. letters patent entitled "CONTINUOUS PROCESS FOR CELLULOSE SACCHARIFICATION," filed on even date herewith in the names of John Armstead Church, Derek Woolridge, Reginald Livingstone Burroughs, Adolph Anthony Strezepek and William James Thompson, and bearing Ser. No. 2885, filed Jan. 12, 1979 now U.S. Pat. No. 4,201,596 granted May 6, 1980; the specification thereof is hereby incorporated by reference.

Thus, it can be seen that the present invention provides a novel reactor system for continuously effecting the hydrolysis of cellulosic materials as relatively concentrated aqueous mixtures, which system reduces the tendency for the mixtures to dewater, and thereby to cause clogging thereof. More specifically, novel high solids pump apparatus suitable for use in such a system is provided, through which an aqueous high-solids mixture may move relatively freely, thereby minimizing dewatering and clogging, which apparatus is also capable of feeding the material at high rates of speed. In particular, a novel valve contributes fundamentally to the attainment of such results, and a unique hopper design is also of considerable importance thereto. The system, apparatus and valve disclosed are of relatively uncomplicated construction, and are of modest cost.

Having thus described the invention, what is claimed is:

1. A reactor system for continuously effecting the hydrolysis of cellulosic materials as relatively concentrated aqueous mixtures, comprising: a tubular reactor having an infeed end and a product discharge end with a reaction zone therebetween; high solids pump means for substantially continuously feeding a relatively concentrated aqueous mixture of a cellulosic material into said reactor connected to said infeed end thereof; said high solids pump means including a pair of hoppers each having a feed ram individual thereto, a charging barrel surrounding each feed ram and communicating with said reactor, each feed hopper including a moveable wall terminating in a curved element defining a cut-out in said charging barrel thereby creating a window in the barrel, said curved element being movable from a first position in which said window is open to a second position in which said window is closed; means for continuously injecting steam into said reactor at a location between said infeed end and said reaction zone; a valve in said reactor adjacent said discharge end adapted to alternatingly close and open said reactor, so as to prevent and to permit discharge of the reaction mass therefrom; control means for operating said valve in response to pressure within said reaction zone, for substantially continuously effecting the discharge of the portion of the reaction mass therefrom; and means for collecting the hydrolyzate so discharged, and for recovering the reaction products contained therein.

2. The system of claim 1 wherein said steam injecting means is also adapted for the continuous injection of acid into said reactor at the same location.

3. The system of claim 1 additionally including cooling means for lowering the temperature of the hydrolyzate downstream of said valve.

* * * * *